US005658071A

United States Patent [19]

Kelpin

[11] Patent Number: 5,658,071

[45] Date of Patent: Aug. 19, 1997

[54] LIGHTING SYSTEM INCLUDING ADJUSTABLE LOUVER

[75] Inventor: Charles A. Kelpin, Vicksburg, Miss.

[73] Assignee: Cooper Industries, Inc., Houston, Tex.

[21] Appl. No.: 571,121

[22] Filed: Dec. 12, 1995

[51] Int. Cl.[6] ..... F21V 17/02

[52] U.S. Cl. ..... 362/325; 362/290; 362/277

[58] Field of Search ..... 362/290, 291, 362/292, 277, 279, 280, 281, 342, 354, 319, 325, 321, 323, 359

[56] References Cited

U.S. PATENT DOCUMENTS

| | | | |
|---|---|---|---|
| 1,013,327 | 7/1912 | Gray et al. | 362/290 |
| 1,141,122 | 6/1915 | Kliegl . | |
| 1,204,888 | 11/1916 | Large | 362/325 |
| 1,434,302 | 10/1922 | Marcotte | 362/279 |
| 1,550,600 | 8/1925 | Wilkie | 362/325 |
| 2,421,057 | 5/1947 | Dunkelberger | 362/277 |
| 2,587,371 | 2/1952 | Nettesheim . | |
| 3,007,034 | 10/1961 | Reed et al. . | |
| 3,606,019 | 9/1971 | Deaton | 362/290 |
| 4,261,028 | 4/1981 | Adam . | |
| 4,485,599 | 12/1984 | Perradin | 362/290 |
| 4,499,529 | 2/1985 | Figueroa | 362/342 |
| 4,999,757 | 3/1991 | Poppenheimer . | |
| 5,077,649 | 12/1991 | Jackel et al. | 362/325 |
| 5,156,454 | 10/1992 | White . | |
| 5,390,092 | 2/1995 | Lin | 362/290 |
| 5,526,241 | 6/1996 | Ferrell | 362/325 |

*Primary Examiner*—Thomas M. Sember
*Attorney, Agent, or Firm*—Burns, Doane, Swecker & Mathis, LLP

[57] ABSTRACT

A lighting system includes a lighting fixture having a wall having an opening therein, the opening being defined by edges of the wall. The lighting system further includes one or more louvers. Each louver includes a louver body having a first and a second end and grips for gripping the edges of the wall disposed at the first and second ends of the louver body to suspend the louver body across the opening. The grips are slidably movable to different points along the edges of the wall. A method of making a lighting system is also disclosed.

13 Claims, 5 Drawing Sheets

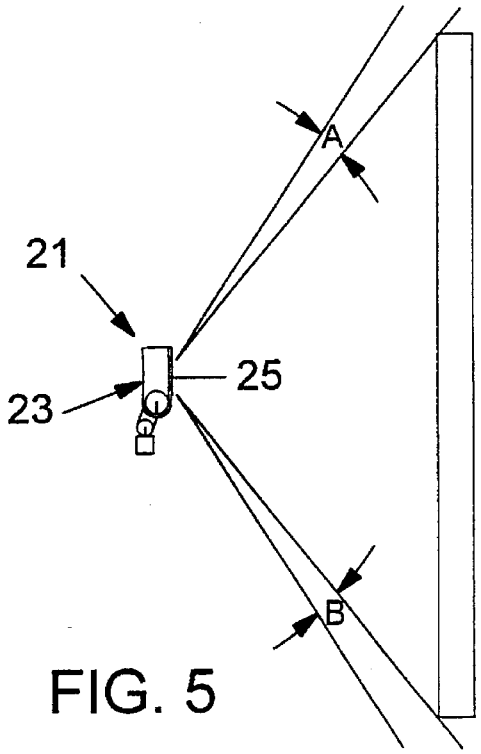
FIG. 5
FIG. 6A
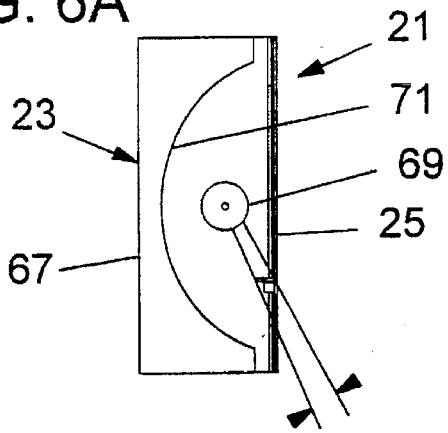
FIG. 6B
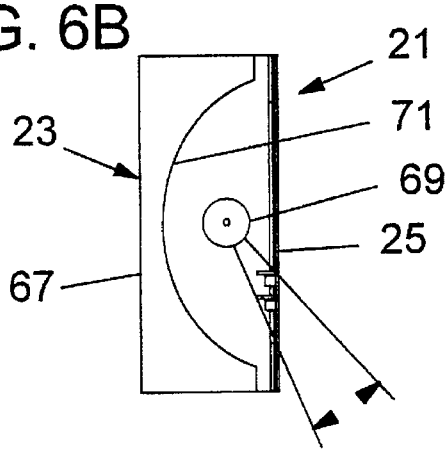

LIGHTING SYSTEM INCLUDING ADJUSTABLE LOUVER

FIELD OF THE INVENTION

The present invention relates to lighting systems and, more particularly, to lighting systems including one or more adjustable louvers.

BACKGROUND AND SUMMARY

Many lighting systems utilize a light source such as a bulb that emits light through 360° around the light source in conjunction with a reflector that may be specially designed to optimize photometric performance so that light is emitted from the lighting system through only a certain desired angle around the light source. It is well-known to further limit the angle through which light can be emitted from the light source by blocking a certain portion of that angle with devices such as louvers. The use of numerous louvers, however, tends to reduce photometric performance of the lighting system, since louvers are not at optimum positions for the particular lighting systems.

For certain types of lighting systems, such as the area or street light that directs light substantially in one direction as disclosed in U.S. Pat. No. 4,261,028 to Adam, it has been found to be useful to provide removable louvers so that the amount of light blocked by the louvers can be adapted for the specific application at hand. This arrangement is, however, relatively inflexible and does not always permit optimal performance, particularly where a lighting system ordinarily shines light over a wide area, as with a floodlight system, and the same lighting system must be adapted to various specific circumstances. It is, therefore, desirable to provide a lighting system having adjustable louvers wherein optimal adjustment of the louvers is possible.

Certain lighting systems, such as floodlight systems, are mounted on poles or other objects in the outdoors and tend to be subjected to high winds. The mounting of the lighting systems must be sufficiently strong to prevent the lighting systems from being blown away. Accordingly, the drag on the lighting systems is an important consideration in the design of lighting systems. Typical louvered lighting systems, such as that disclosed in the abovementioned Adam patent, provide the louvers on the outside of the lighting system where they tend to add to drag on the lighting system, thus limiting the size of the system both in terms of size of an individual lighting fixture and in terms of the number of lighting fixtures that can be mounted on a single mounting device, such as a pole. It is, therefore, desirable to limit the amount of drag in a lighting system.

In accordance with one aspect of the present invention, a lighting system includes a lighting fixture having an opening, the opening being defined by the edges of a wall. The lighting system also includes one or more louvers, each louver including a louver body having a first and a second end and means for gripping the edges of the wall disposed at the first and second ends of the louver body to suspend the louver body across the opening, the gripping means being slidably movable to different points along the edges of the wall.

In accordance with another aspect of the present invention, a louver for a lighting system includes a louver body having first and second ends, and C-shaped clip members disposed at each of the first and second ends.

In accordance with still another aspect of the present invention, a method for making a lighting fixture is disclosed. According to the method, a lighting fixture having a wall having an opening therein is provided, the opening being defined by edges of the wall. A louver is attached across the opening. The louver includes a louver body having a first and a second end and means for gripping the edges of the wall disposed at the first and second ends of the louver body, the gripping means permitting sliding movement of the first and second ends louver from one position on the edges of the wall to another.

BRIEF DESCRIPTION OF THE DRAWINGS

The features and advantages of the present invention are well understood by reading the following detailed description in conjunction with the drawings in which like numerals indicate similar elements and in which:

FIG. 5 is a side view of a lighting system according to an embodiment of the present invention showing elimination of glare with horizontally oriented louvers;

FIGS. 6A–6B are partially cross-sectional top views of lighting systems according to embodiments of the present invention;

DETAILED DESCRIPTION

Figure 1:
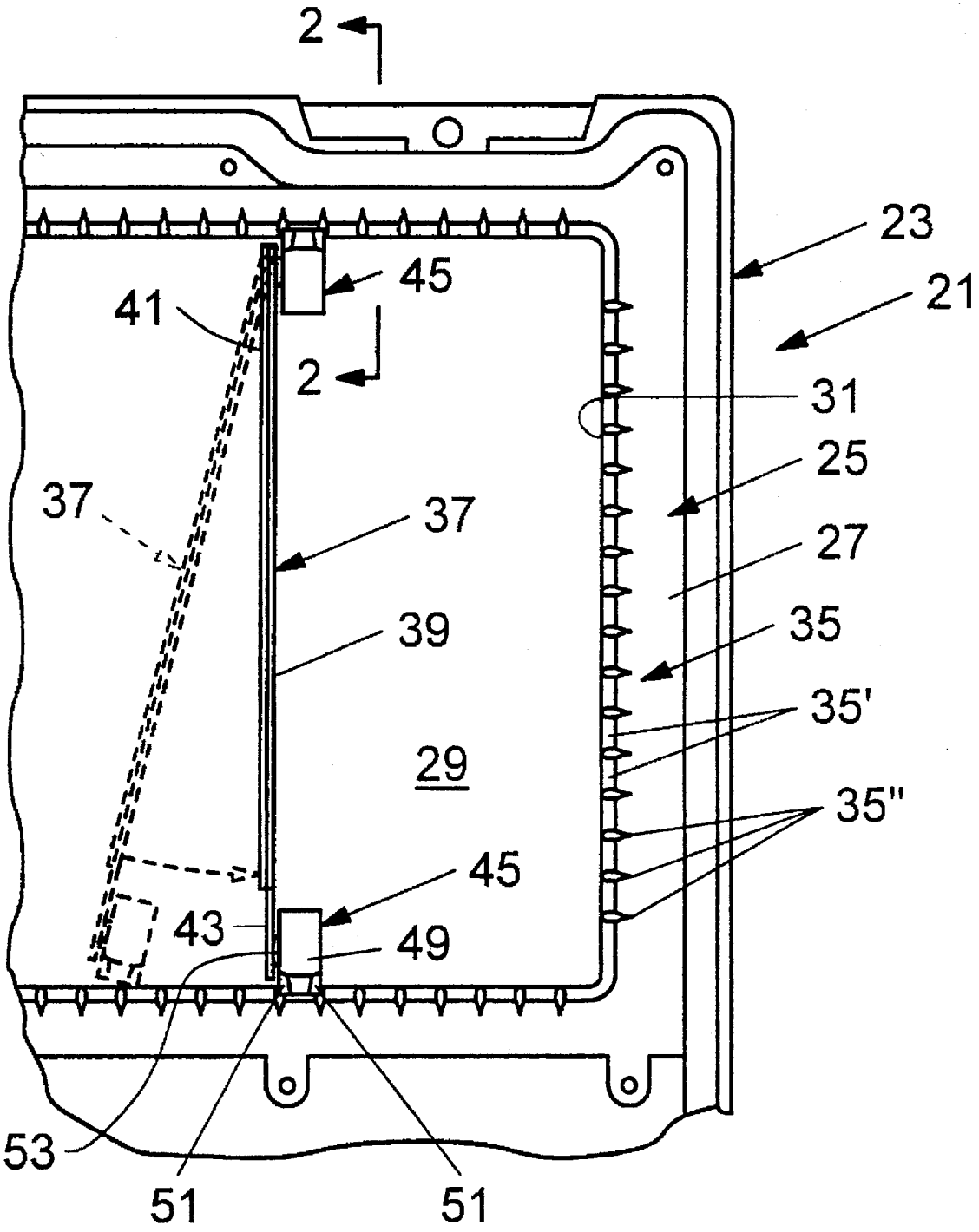
FIG. 1 is a partial view of a lighting system, taken from inside of a lighting fixture thereof, according to an embodiment of the present invention.
Figure 2:
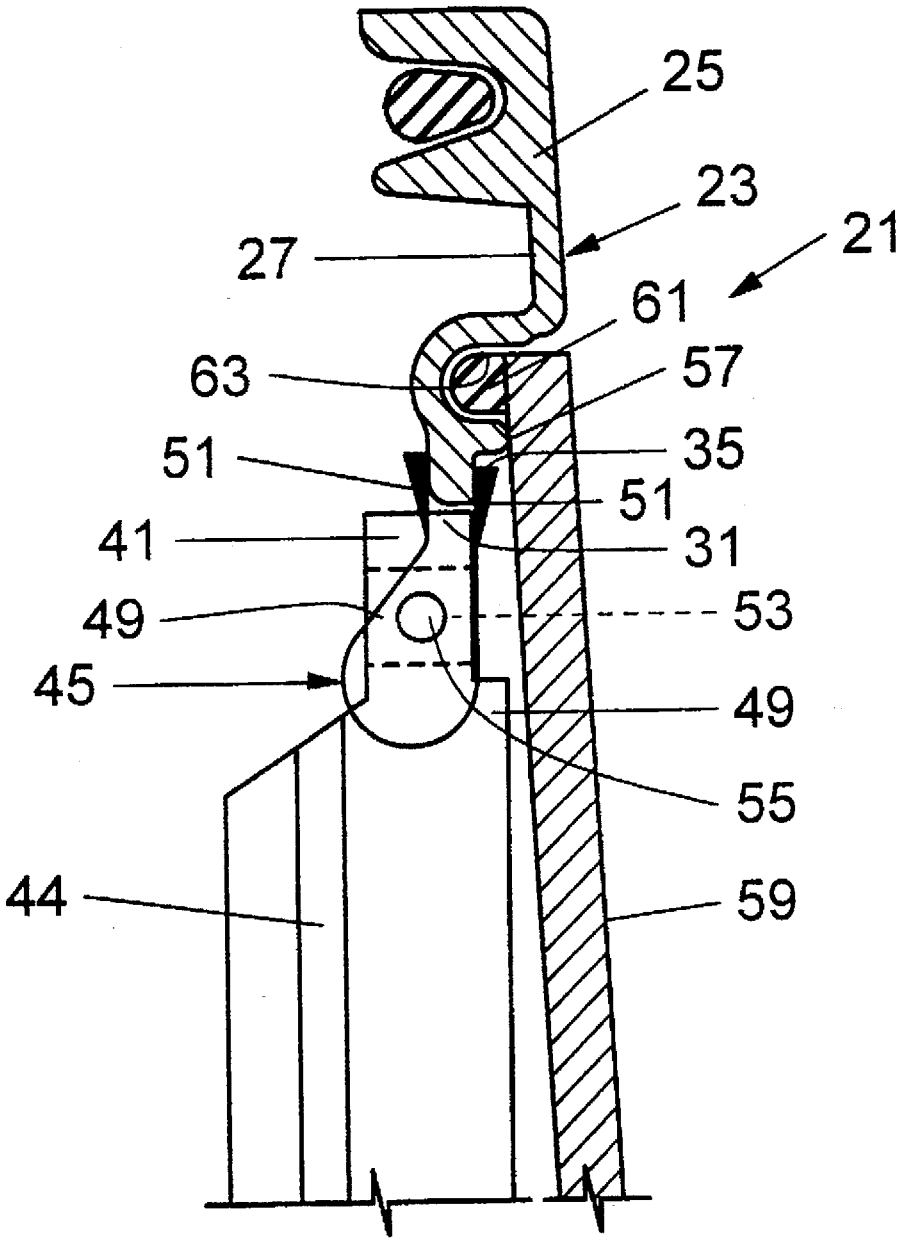
FIG. 2 is a partially cross-sectional side view of the lighting system of FIG. 1 taken at section 2—2.

A lighting system 21 according to an embodiment of the present invention is seen in FIGS. 1 and 2. The lighting system 21 includes a lighting fixture 23 having a wall 25 having an inner side 27. The wall 25 has an opening 29 therein defined by edges 31 of the wall, the opening preferably being rectangular. The edges 31 of the wall 25 preferably include a plurality of ramped areas including recesses 35.

The lighting system 21 preferably further includes one or more louvers 37. Each louver 37 has a louver body 39 having a first end 41 and a second end 43. The louver body 39 is preferably substantially flat and provided with a longitudinal ridge 44 to enhance the rigidity of the louver body. Each louver 37 also preferably has, at each of the first and second ends 41 and 43, grips 45 for gripping the edges 31 of the wall 25 so that the louver can be suspended across the opening 29 in the wall 25. The grips 43 preferably slidably grip the edges 31 of the wall 25 so that the grips can be slidably moved to different points along the edges of the wall as desired. As seen in FIG. 1, a louver 37 is preferably attached across the opening 29 in the wall 25 by first attaching a grip 45 at one end, e.g., the first end 41 of the louver body 39 to the edge 31 of the wall, and then pivoting the louver about that grip until the grip at the other end 43 of the louver body is in position.

The grips 45 are preferably indexed in different positions along the edges of the wall by being received in selected ones of the recesses 35. The grips 45 are preferably in the form of C-shaped clips in which the edges 31 of the wall 23 are received. The C-shaped clips tend to grip the edges of the wall at the lowest points 35' in the recesses 35 such that the grips are slidably moved only by exerting some force on the grips so that the legs 49 of the C-shaped clips will be caused to expand in order to permit the thicker points 35" of the wall 25 to be received between the legs of the C-shaped clips. Corners 51 of the legs 49 are preferably turned upwardly to facilitate sliding the grips 45 along the edges 31 of the wall 25. As seen in FIG. 2, the grips 45 preferably include a tab 53 formed integrally with the C-shaped clip, the tab 53 being secured to the first or second ends 41 or 43 of the louver body 39, such as by a rivet 55. The grips 45 are preferably secured to the louver 37 such that the grips are disposed on the same side of the louver.

The edges 31 of the wall 25 are preferably recessed relative to a portion 57 of the wall across which a light transmitting cover 59 is preferably mounted. Gaskets 61 are preferably provided in recesses 63 in the wall 25 around the periphery of the opening 29 to ensure a tight seal between the cover 59 and the wall. As will be seen from, e.g., FIG. 2, in the lighting system according to the present invention, the louvers 37 are entirely enclosed within the lighting fixture, with an edge of the louver being inside of an inner wall of the cover 59. The louvers 37, thus, do not contribute to drag on the lighting fixture, and facilitate the use of greater numbers of lighting fixtures or larger lighting fixtures on a single mounting structure, such as a pole.

Figure 3A:
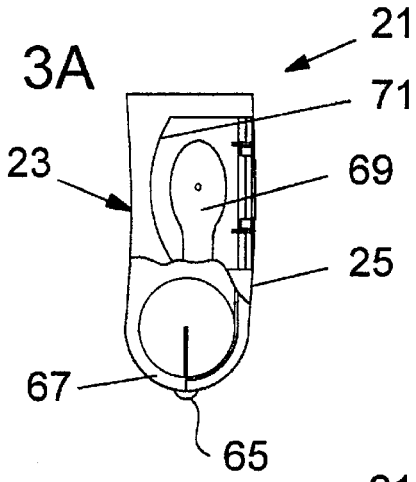
FIGS. 3A–3B are partially cross-sectional side views of lighting systems according to embodiments of the present invention.
Figure 3B:
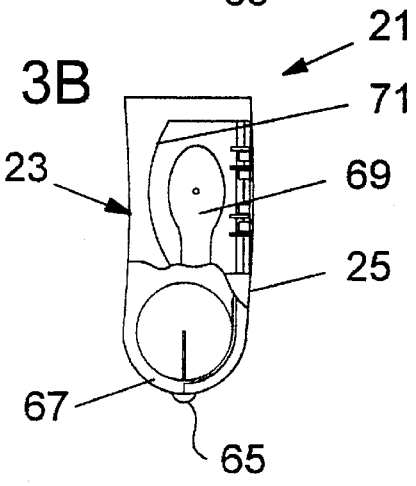
Figure 4A:
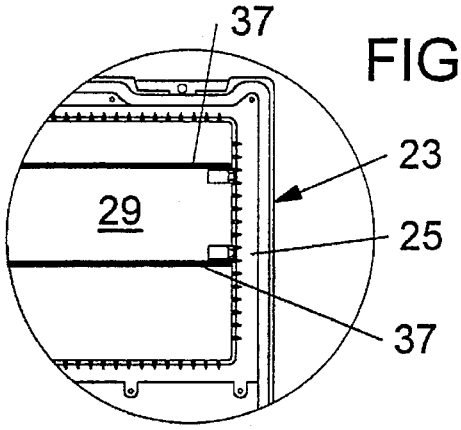
FIGS. 4A–B are partial views of the lighting systems of FIGS. 3A–3B, respectively, taken at sections 4A—4A and 4B—4B, respectively.
Figure 4B:
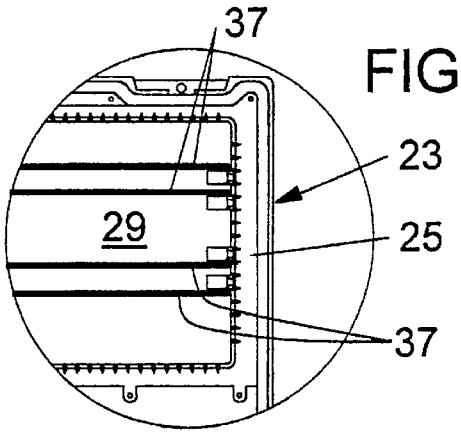
Figure 7A:
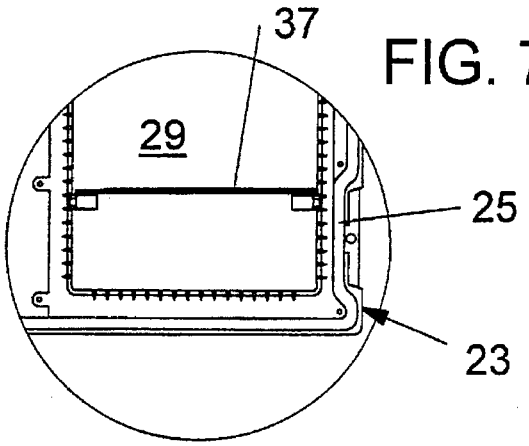
FIGS. 7A–7B are partial views of the lighting systems of FIGS. 6A–6B, respectively, taken at sections 7A—7A and 7B—7B, respectively.
Figure 7B:
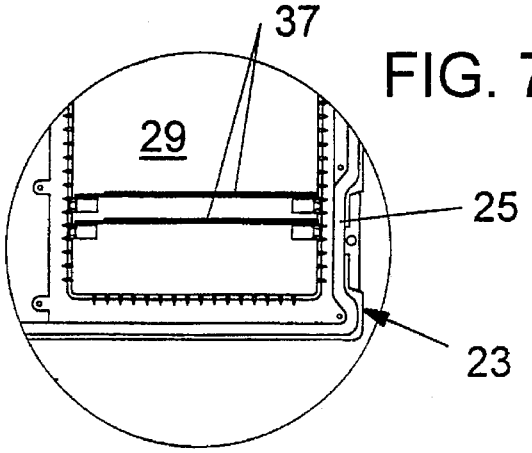
Figure 8:
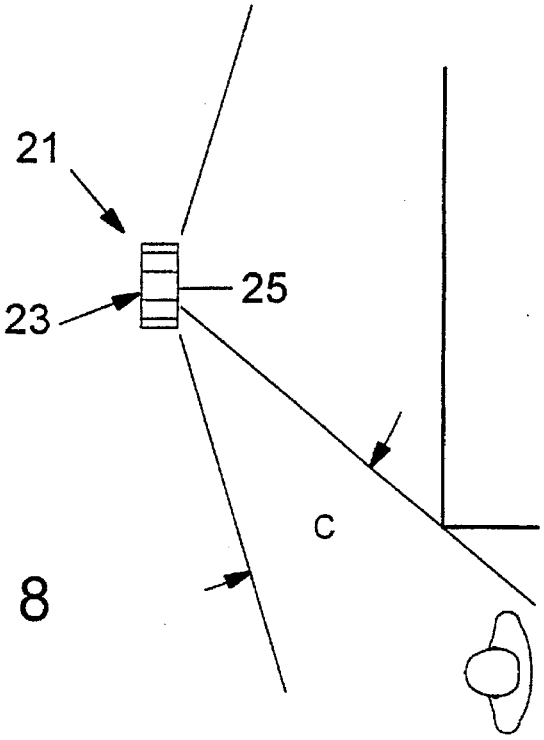
FIG. 8 is a side view of a lighting system according to an embodiment of the present invention showing elimination of glare with one or more vertically oriented louvers.

The lighting system 21 according to the present invention is preferably a floodlight system, however, the present invention is useful in connection with street or area and other lighting systems in which louvers are useful, as well. As seen in FIGS. 3A–3B, the wall 25 of the lighting fixture 23 is preferably attached by a hinge 65 to a lighting fixture body 67 including a light source 69 and a reflector 71. As seen in FIGS. 3A–3B and 6A–6B, the reflector 71 is preferably parabolic or otherwise shaped to optimize photometric performance of the lighting fixture. FIGS. 3A–3B show embodiments of the lighting system in partial cross-section as viewed from the side. FIGS. 4A–4B are enlarged views, taken from inside the lighting fixture 23, of the lighting system of FIGS. 3A–3B, respectively, showing different possible arrangements of louvers 37 across the opening 29 in the wall 25. As seen in FIG. 5, orienting louvers 37 in a lighting system 21 as shown in FIGS. 3A–3B and 4A–4B, such that the louvers extend horizontally across the opening 29 in the wall, desired portions A and B of the total bare lamp angle of light can be eliminated, thereby eliminating unwanted glare with a minimal sacrifice in efficiency of the lighting system. FIGS. 6A–6B show embodiments of the lighting system in partial cross-section as viewed from above. FIGS. 7A–7B, are enlarged views of the lighting system 21, taken from inside the lighting fixture 23, of the lighting system of FIGS. 6A–6B, respectively, showing different possible arrangements of louvers 37 across the opening 29 in the wall 25. As seen in FIG. 8, orienting louvers 37 in a lighting system 21 as shown in FIGS. 6A–6B and 7A–7B, such that the louvers extend vertically across the opening 29 in the wall, desired portions C of the total bare lamp angle of light can be eliminated, thereby eliminating unwanted glare with a minimal sacrifice in efficiency of the lighting system. From the foregoing, it will be appreciated that the louvers 37 can be arranged in various different ways to eliminate unwanted glare. If it is desired or necessary to alter the position of a louver 37 in a lighting fixture 23, the louver is easily slid from one position to another, or removed completely.

While this invention has been illustrated and described in accordance with a preferred embodiment, it is recognized that variations and changes may be made therein without departing from the invention as set forth in the claims.

What is claimed is:

1. A lighting system, comprising:

a lighting fixture having a wall having an opening therein, the opening being defined by edges of the wall;

one or more louvers, each louver including a louver body having a first and a second end and means for gripping the edges of the wall disposed at the first and second ends of the louver body to suspend the louver body across the opening, the gripping means being slidably movable to different points along the edges of the wall, wherein the gripping means includes a C-shaped clip in which the edges of the wall are received.

2. The lighting system as set forth in claim 1, wherein the edges of the wall include a plurality of ramped areas including recesses, the gripping means being disposed along the edges of the wall in the recesses.

3. The lighting system as set forth in claim 2, wherein the edges of the wall are recessed relative to a cover mounting portion of the wall, the lighting system further comprising a cover mounted to the wall over the opening in the cover mounting portion of the wall.

4. The lighting system as set forth in claim 3, wherein the louver body includes a first edge which, when the louver body is suspended across the opening, is disposed inwardly of an inner wall of the cover.

5. The lighting system as set forth in claim 3, wherein the wall having the opening therein is attached to a body of the lighting fixture by a hinge arrangement.

6. The lighting system as set forth in claim 1, wherein the opening in the lighting fixture wall is rectangular.

7. The lighting system as set forth in claim 1, wherein the wall having the opening therein is attached to a body of the lighting fixture by a hinge arrangement.

8. A method for making a lighting fixture, comprising the steps of:

providing a lighting fixture having a wall having an opening therein, the opening being defined by edges of the wall;

attaching a louver across the opening, the louver including a louver body having a first and a second end and means for gripping the edges of the wall disposed at the first and second ends of the louver body, the gripping means including a C-shaped clip in which the edges of the wall are received, the gripping means permitting sliding movement of the first and second ends of the louver from one position on the edges of the wall to another.

9. The method as set forth in claim 8, comprising the further step of sliding the louver to a desired position across the opening by sliding the gripping means along the edges of the wall.

10. A lighting system, comprising:

a lighting fixture having a wall having an opening therein, the opening being defined by edges of the wall;

one or more louvers, each louver including a louver body having a first and a second end and means for gripping the edges of the wall disposed at the first and second ends of the louver body to suspend the louver body across the opening, the gripping means being slidably movable to different points along the edges of the wall, wherein the wall having the opening therein is attached to a housing of the lighting fixture by a hinge arrangement.

11. The lighting system as set forth in claim 10, wherein the edges of the wall include a plurality of ramped areas including recesses, the gripping means being disposed along the edges of the wall in the recesses.

12. The lighting system as set forth in claim 11, wherein the edges of the wall are recessed relative to a cover mounting portion of the wall, the lighting system further comprising a cover mounted to the wall over the opening in the cover mounting portion of the wall.

13. The lighting system as set forth in claim 12, wherein the louver body includes a first edge which, when the louver body is suspended across the opening, is disposed inwardly of an inner wall of the cover.

* * * * *